United States Patent [19]

McLeod et al.

[11] Patent Number: 4,720,886

[45] Date of Patent: Jan. 26, 1988

[54] FLOOR POLISHING MACHINE

[75] Inventors: Rick McLeod, Lake in the Hills; Gary E. Palmer, Roselle, both of Ill.

[73] Assignee: Hako Minuteman, Inc., Addison, Ill.

[21] Appl. No.: 920,714

[22] Filed: Oct. 17, 1986

[51] Int. Cl.[4] ..... A47L 11/204

[52] U.S. Cl. ..... 15/352; 15/353; 15/385; 55/337; 55/342; 55/459 R

[58] Field of Search ..... 15/320, 385, 98, 352, 15/353; 55/337, 342, 459 R

[56] References Cited

U.S. PATENT DOCUMENTS

| | | | |
|---|---|---|---|
| 2,415,372 | 2/1947 | Salt et al. | 15/385 X |
| 3,048,959 | 8/1962 | Lowther | 55/320 |
| 3,710,561 | 1/1973 | Garrone | 55/429 |
| 3,724,181 | 4/1973 | Benson, Jr. | 55/432 |
| 3,853,517 | 12/1974 | Mitchell | 55/459 R X |
| 4,178,654 | 12/1979 | Mitchell | 15/385 |
| 4,598,440 | 7/1986 | Wilson | 15/385 |
| 4,631,775 | 12/1986 | Palmer et al. | 15/385 |

*Primary Examiner*—Chris K. Moore
*Attorney, Agent, or Firm*—Emrich & Dithmar

[57] ABSTRACT

A high speed floor burnisher has a pad assembly rotating at high speed in a vacuum shroud which is evacuated by forced air without a separate vacuum motor. The evacuated air and entrained dust and debris are routed to a filter assembly with a replaceable filter and a removeable receptacle provided with a trap for larger particles so that they do not plug the filter, and thereby prolong its useful life.

3 Claims, 4 Drawing Figures

FLOOR POLISHING MACHINE

FIELD OF THE INVENTION

The present invention relates to floor polishing or burnishing machines; and more particularly, it relates to high speed floor burnishers having a pad driver assembly which is driven at a high speed and is enclosed within a vacuum shroud. Air is moved between the shroud and the pad driver assembly to evacuate the area beneath the shroud and to carry away dust and debris generated during the burnishing process. In this connection, the term "high speed" refers to an angular velocity higher than 1,000 RPM and which may be as high as 3,000 RPM.

BACKGROUND AND SUMMARY OF THE INVENTION

In high speed floor burnishers, dust and debris are created as the high speed burnishing pad scours the floor. Tiny particles of dirt or previous floor coverings may be driven outwardly at fairly high speed; and unless some provision is made, the dust can diminish the overall effect intended to be produced by the machine.

It has become desirable to enclose the pad driver assembly in a shroud which is evacuated continuously so that the dust and debris becomes entrained in a continuous air flow.

One of the objects of the present invention is to provide a means for continuously filtering the air evacuated from the vacuum shroud, but a problem arises in that the amount of dust and debris and the volume of air to be filtered are so great that a filter of any reasonable size may have to be changed too frequently to be convenient.

The present invention advantageously overcomes this disadvantage by providing that the filter and debris collection assembly (through which the evacuated air is routed) includes a removable receptacle above which the filter rests and is mounted.

The receptacle includes a generally annular area for routing the air at fairly high speed in a generally circular pattern, and the receptacle is provided with an upwardly inclined bottom wall or ramp to pass the air upwardly and through the filter while creating a low vacuum area or trap into which the heavier debris falls and is collected. The receptacle also includes a dam partially defining the debris trap so that the debris which is trapped does not re-enter the air stream, but remains trapped.

In a preferred embodiment, the filter is readily removable from the receptacle, and the receptacle is removable from the filter assembly housing so that the heavy debris can be discarded readily.

Other features and advantages of the present invention will be apparent to persons skilled in the art from the following detailed description of a preferred embodiment accompanied by the attached drawing wherein similar reference numerals will refer to like parts in the various views.

DESCRIPTION OF THE PREFERRED EMBODIMENT

Figure 1:
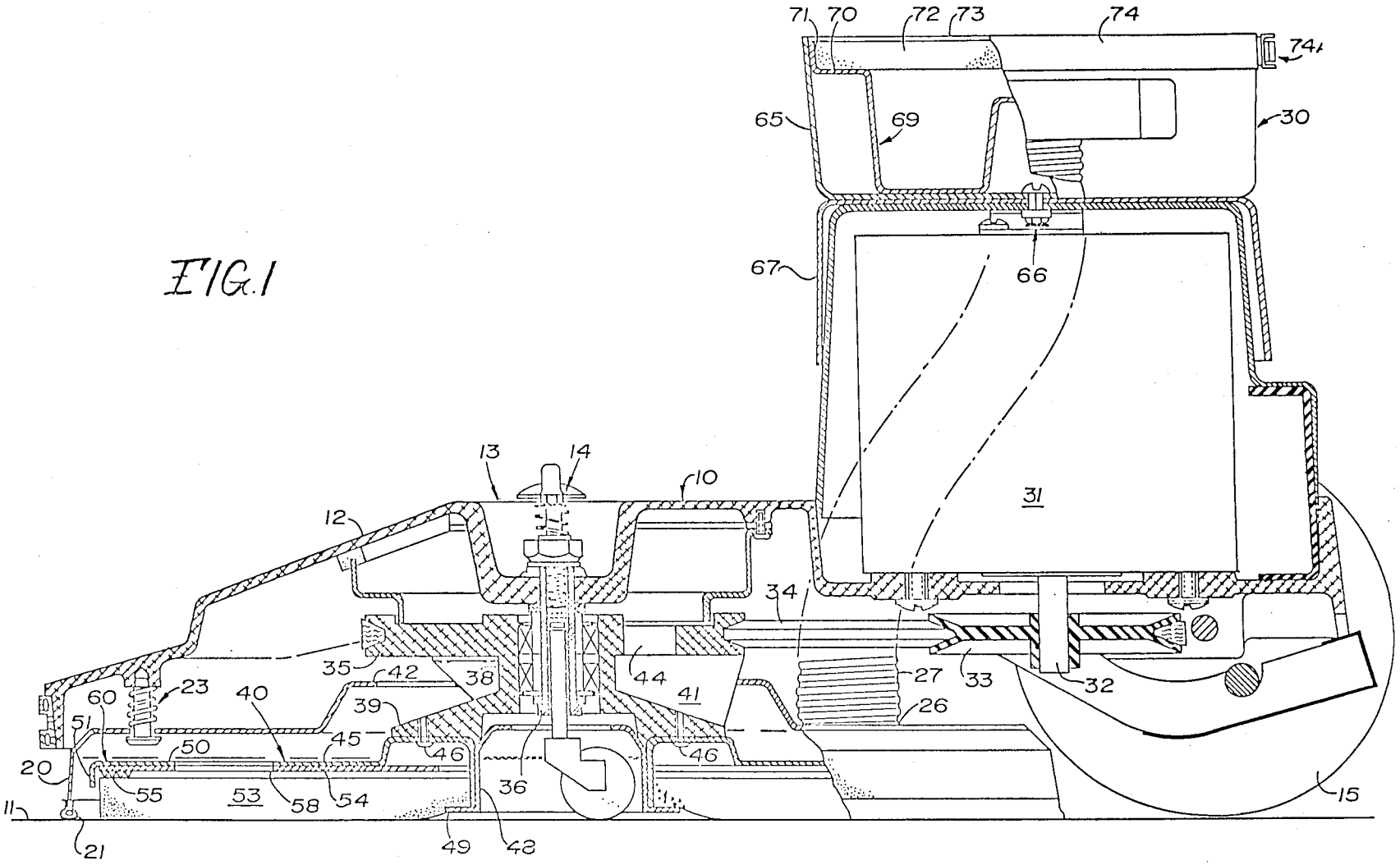
FIG. 1 is a vertical cross-sectional view of a burnishing machine incorporating the features of the present invention, taken along the fore-to-aft center line of the machine.

The present invention incorporates improvements to a floor burnishing machine such as is disclosed in co-owned, co-pending U.S. application of Todd and Palmer, Ser. No. 807,679, filed Dec. 11, 1985 for IMPROVEMENTS IN HIGH SPEED FLOOR BURNISHER. Thus, many of the details of the machine need not be disclosed further for an appreciation of the present improvements.

Referring now to the drawing, there is illustrated a high speed floor burnishing machine, generally designated by the numeral 10, for use in polishing or burnishing a floor represented by the horizontal line 11. The machine 10 includes a housing 12 which has a centrally located recess 13 in the top portion for mounting a caster wheel assembly 14, which is conventional. The housing 12 is supported for movement along the floor 11 by a pair of coaxial wheels 15 mounted rearwardly of the housing 12. There is also provided a handle (not shown) operatively connected to the housing 12 so that the user of the machine can propel and control it as desired.

A vacuum shroud 20 is suspended beneath the housing 12 and has a circular lower edge provided with a flexible floor seal 21 disposed in use in sealing engagement with the floor 11. The shroud 20 is suspended from the housing 12 by a plurality of spring mounts, such as the one illustrated at 23, so that the vacuum shroud 20 is mounted for independent movement relative to the housing 12. The shroud 20 defines a chamber and is provided adjacent to the rear end thereof with an upwardly extending discharge portion 26 which communicates with conduit 27, which in turn communicates with a fitting 28 which leads into a collection and filter assembly generally designated 30.

Mounted above the housing 12 is an electric motor 31 having an output shaft 32 coupled to a pulley 33 which drives a belt 34 connected in turn to a pulley 35. The pulley 35 is journalled on a shaft 36 which is fixed in the center of the well 13 of housing 10 and receives the center caster assembly 14.

Figure 2:
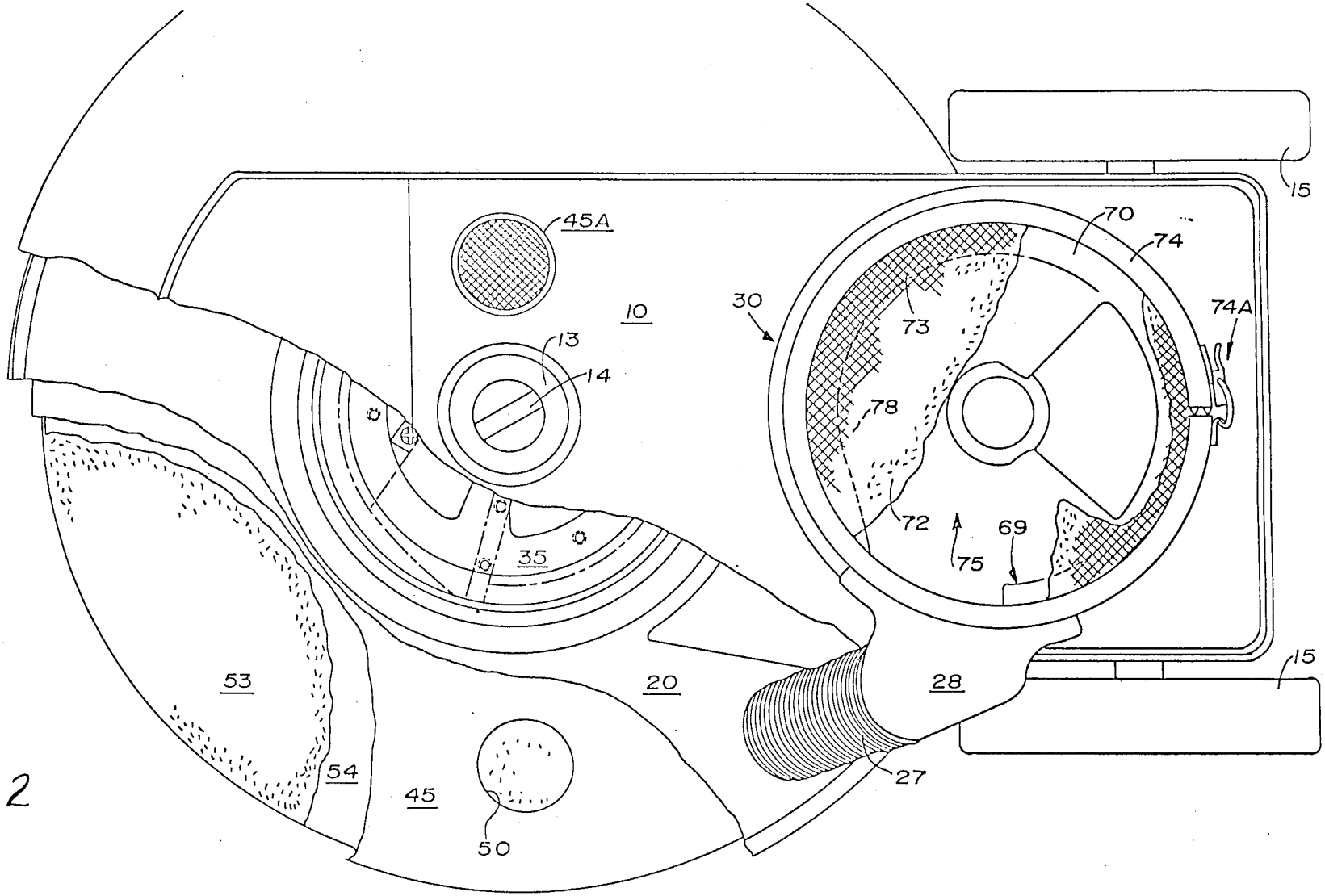
FIG. 2 is a plan view of the machine of FIG. 1 with portions broken away to show features of the construction more clearly.

The pulley 35 is a casting which includes a downwardly extending central portion 38 which is outwardly flanged at 39 for mounting a pad driver assembly generally designated 40. A plurality of radially extending fins such as that designated 41 may be formed in the pulley 35; and apertures such as that designated 44 may also be formed in the pulley 35 to permit air to flow downwardly from beneath the central portion of the housing 12, where it enters through an aperture 45A (FIG. 2). The fins 41 force the air radially outwardly in the space between the shroud 20 and the pad driver 40, the pulley 35 being located in a central aperture 42 in the shroud 20.

The pad driver assembly 40 includes a backing plate 45 of semi-rigid plastic such as ABS and which is mounted by fasteners 46 to the flange 39 of the pulley 35 to rotate therewith. An inverted cup 48 having a laterally outwardly extending flange 49 is press-fitted into a central collar of the backing plate 45. The backing plate 45 also includes a plurality of apertures 50 which may be circular when viewed from the top and are located with their centers at approximately seventy percent of the radius of the pad driver assembly. The backing plate 45 also includes an integral outer depending skirt 51.

The pad driver assembly also includes a flexible burnishing pad 53 located beneath a gripper element 54. The gripper element 54 has formed on its underside a plurality of projections or teeth such as those seen at 55 in the lower left corner of FIG. 1. The teeth 55 typically extend throughout the entire surface of the gripper element 54, but some have been omitted for brevity. The teeth 55 are forced into the upper surface of the pad 53 and cooperate with the retaining flange 51 to restrain the pad 53 by gripping it. Further, the center of the pad 53 is held between the central portion of the gripper member 54 and the flange 49 of the cup 48.

The gripper element 54 is also apertured as seen at 58 with apertures similar in size and location to the apertures 50 in the backing plate 45, and the apertures of the gripper element 54 are in register or alignment with the apertures 50 of the backing plate. Since the primary function of the gripper element 54 is to provide teeth or projections to engage the pad 53, the teeth 55 could be integrally formed on the under side of the backing plate 45 without loss of function.

The pad 53 is a conventional polishing pad, formed of very loosely intertwined fiber-like strands which will withstand the considerable abrasion effect of high speed polishing.

In operation, when the motor 31 drives the pulley 35, the pad driver assembly 40 is rotated, the fins 41 establish a radial air flow over the top of the pad driver assembly to force air and any entrained particles or dust in the space between the vacuum shroud 20 and the pad driver assembly through discharge conduit 27 into the filter assembly 30.

Figure 3:
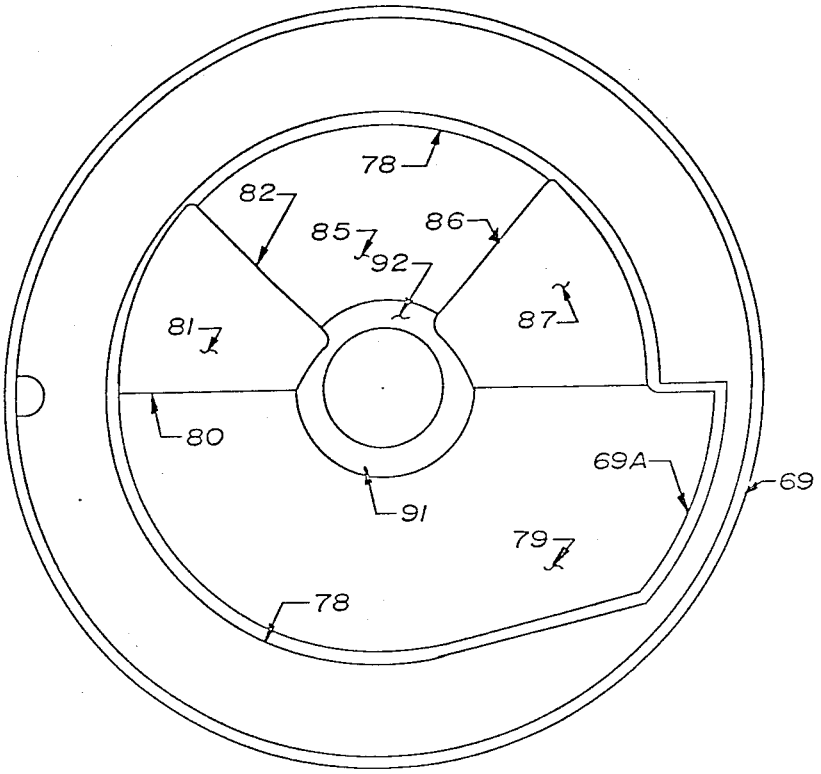
FIG. 3 is a top view of the removable receptacle of the collection and filter assembly of FIG. 1.
Figure 4:
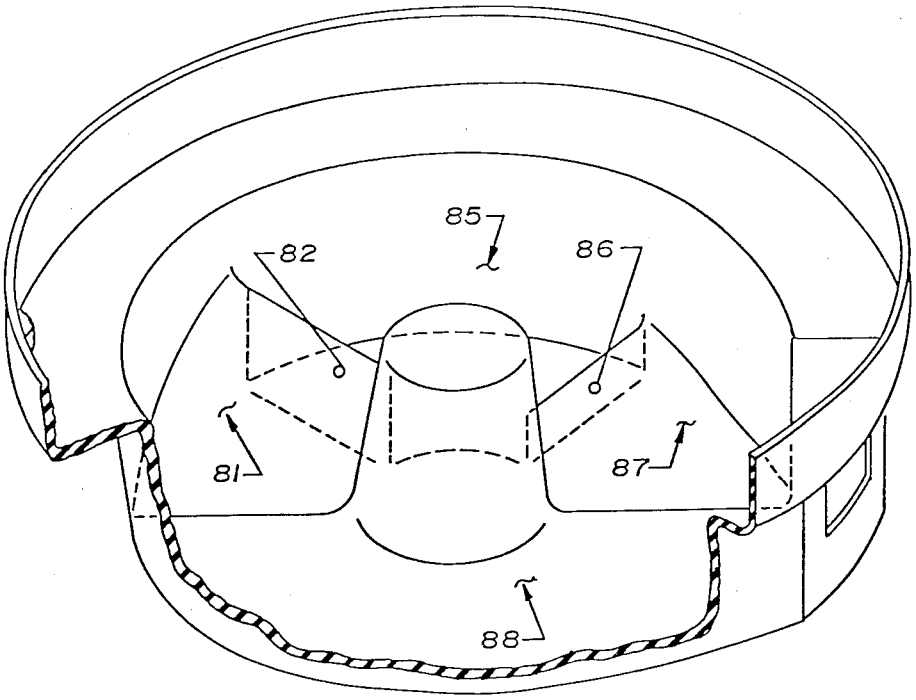
FIG. 4 is an upper perspective view of the receptacle of FIG. 3 showing the debris collection area.

Turning now to the debris collection and filter assembly 30 as seen in FIG. 1, it includes an outer housing 65 in the form of a tray which is attached by a threaded fastener 66 to a cover 67 for the housing of the electric motor 31. Located within the filter housing 65 is a removable collection receptacle generally designated 69 (FIGS. 3 and 4). The removable receptacle 69 includes an upper horizontal flange 70 extending about its periphery; and at the outer edge of the horizontal flange 70 there is a generally upright flange 71. The horizontal flange 70 and vertical flange 71 cooperate to define a holder for a disposable filter 72. A metal screen 73 is located above the filter 72 and secured by a band 74 and clamp 74A to the housing 65.

As best seen in FIGS. 2 and 3, the inlet fitting 28 and conduit 27 route air exhausted from beneath the vacuum shroud through the housing 65 and an inlet opening 69A into the receptacle 69 in the direction of the arrow 75 (FIG. 2).

The receptacle 69 includes a generally upright outer wall 78 which extends from the inlet opening in the receptacle adjacent the inlet opening 69A in a generally circular path approximately 180° about the receptacle to a location designated by reference numeral 80 in FIG. 3 where the bottom surface of the receptacle, which theretofore had been generally flat as at 79, begins an area of incline generally designated 81 in an upward direction, thereby forcing the air upwardly and at least partially through the filter 72.

The ramp surface 81 is then formed abruptly downwardly at 82 to form a generally vertical wall, as seen in FIG. 4. The vertical wall 82 partially defines a debris collection area or trap 85 which is located approximately 270° from the inlet area. The downstream end of the collection area 85 is defined by another, smaller vertical wall 86 and another inclined wall 87, as best seen in FIG. 4. The vertical wall 86 and sloped wall 87 form a dam for preventing any heavier or larger particles trapped in the collection area 85 from re-entering the circular flow of air; and the inclined surface 87 at least partially conforms the flow pattern of the circulating air back to the flat bottom surface 79 of the receptacle 69 adjacent the inlet opening 69A.

At the center of the receptacle 69 is a frustoconical member generally designated 91, the purpose of which is to avoid any pockets where it might be undesirable to trap heavier debris and at least partially to define the collection area 85, as indicated by the wall 92. The outer surface of the collection area 85 is defined by a continuation of the circular side wall 78 of the receptacle.

In operation, air entering the inlet opening 69A travels in a generally straight, horizontal direction, but it is forced into a circular pattern approximately one-quarter of the way around the path of the air. In another quarter turn, the air is forced up the inclined surface 81, at least partially penetrating the filter, and thereby exiting the debris collection and filter assembly. When the air, which is moving at a fairly high velocity, encounters the abrupt vertical surface 82, a low pressure area is created, thereby encouraging heavier particles to fall out and be trapped between the walls 82, 86, 92 and 78.

The collection of the heavier debris prolongs the useful life of the filter, and the assembly permits the receptacle 69 to be removed and the heavier debris discarded without otherwise diminishing the effectiveness of the filter.

Having thus disclosed a preferred embodiment, persons skilled in the art will be able to modify certain elements of the structure which has been described and substitute equivalent elements for those illustrated while continuing to practice the principle of the invention; and it is, therefore, intended that all such modifications and substitutions be covered as they are embraced within the spirit and scope of the appended claims.

We claim:

1. In a high speed floor burnishing machine, the combination comprising a pad driver assembly including a pad adapted to contact the floor; a motor for rotating said pad driver assembly at high angular velocity; means for generating a continuous air flow outwardly of said rotating driver assembly for entraining debris generated by said rotating driver assembly; shroud means enclosing said driver assembly; collection means including a filter in fluid communication with said shroud means for receiving said air flow and entrained debris and defining a generally upright wall having at least a portion being generally cylindrical for routing said air and entrained debris in a generally circular pattern, and further including an upwardly inclined surface for further routing said air toward said filter for filtering out dust and light material from said air, and means for trapping heavier material adjacent the termination of said upwardly inclined surface.

2. The apparatus of claim 1 wherein said collection means further comprises a housing mounted to said burnishing machine, said receptacle being removably received in said housing and defining a peripheral horizontal surface for partially supporting said filter, whereby said filter may be removed from said receptacle for cleaning or replacement.

3. The apparatus of claim 1 wherein said trapping means is partially defined by a generally vertical first wall adjacent the uppermost portion of said upwardly inclined surface; and a separate vertical wall extending generally radially of said cylindrical wall portion and spaced from said first vertical wall in the direction of movement of said air therein.

* * * * *